US008657404B2

(12) United States Patent
Nishida

(10) Patent No.: US 8,657,404 B2
(45) Date of Patent: Feb. 25, 2014

(54) LIQUID DROPLET JETTING APPARATUS

(75) Inventor: Katsunori Nishida, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 213 days.

(21) Appl. No.: 13/242,230

(22) Filed: Sep. 23, 2011

(65) Prior Publication Data

US 2012/0081427 A1 Apr. 5, 2012

(30) Foreign Application Priority Data

Sep. 30, 2010 (JP) ..... 2010-220902

(51) Int. Cl.
*B41J 2/165* (2006.01)
*B41J 29/38* (2006.01)

(52) U.S. Cl.
USPC ..... 347/29; 347/9

(58) Field of Classification Search
None
See application file for complete search history.

(56) References Cited

U.S. PATENT DOCUMENTS

| | | | | |
|---|---|---|---|---|
| 7,695,095 | B2 * | 4/2010 | Shindo | 347/29 |
| 2004/0150692 | A1 | 8/2004 | Hara | |
| 2007/0134969 | A1 | 6/2007 | Endo et al. | |
| 2008/0192083 | A1 * | 8/2008 | Nishida | 347/30 |
| 2008/0218554 | A1 | 9/2008 | Inoue | |
| 2010/0238230 | A1 | 9/2010 | Endo et al. | |

FOREIGN PATENT DOCUMENTS

| | | |
|---|---|---|
| JP | 10-258531 | 9/1998 |
| JP | 2004/237557 | 8/2004 |
| JP | 2007/176152 | 7/2007 |
| JP | 2008/221836 | 8/2008 |
| JP | 2008/221534 | 9/2008 |
| JP | 2008-260172 | 10/2008 |

OTHER PUBLICATIONS

Notice of Reasons for Rejection for Japanese Patent Application No. 2010-220902 dated Mar. 19, 2013.

* cited by examiner

*Primary Examiner* — Geoffrey Mruk
(74) *Attorney, Agent, or Firm* — Frommer Lawrence & Haug LLP

(57) ABSTRACT

A liquid droplet jetting apparatus includes: a liquid droplet jetting head which has a liquid droplet jetting surface on which a plurality of nozzles including a first nozzle and a second nozzle are open to jet the liquid droplets; a cap member which covers the liquid droplet jetting surface of the liquid droplet jetting head and in which an opening, through which an interior of the cap member is communicated with atmospheric air in a state that the liquid droplet jetting surface is covered with the cap member, is formed; a moving mechanism which moves the cap member to make contact with and separate from the liquid droplet jetting surface; and a controller which controls the liquid droplet jetting head and the moving mechanism.

9 Claims, 10 Drawing Sheets

LIQUID DROPLET JETTING APPARATUS

CROSS REFERENCE TO RELATED APPLICATION

The present application claims priority from Japanese Patent Application No. 2010-220902, filed on Sep. 30, 2010, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

Conventionally, in a liquid droplet jetting apparatus provided with a liquid droplet jetting head for jetting liquid droplets from nozzles, it has been known that a flushing is performed. In the flushing, a certain amount of liquid is usually discharged by consecutively jetting the liquid droplets a plurality of times from the nozzles, for the purpose of, for example, adjusting meniscus of the nozzles or discharging any liquid, the viscosity of which is increased due to drying.

As the liquid droplet jetting apparatus performing the flushing described above, the ink-jet recording apparatuses which jet inks onto recording objective mediums from nozzles to perform recording are disclosed in Japanese Patent Application Laid-Open No. 2008-260172 and Japanese Patent Application Laid-Open No. H10-258531. In order to restore liquid droplet jetting performance of the nozzles, each of the ink-jet recording apparatuses is configured to be capable of performing a so-called suction purge. In the suction purge, a suction operation of a suction pump is performed to discharge inks from the nozzles into a cap member in such a capping state that the cap member comes into close contact with an ink jetting surface of the ink-jet head to cover the nozzles. In the suction purge, a plurality of color inks discharged by the suction purge are mixed one another and then sucked into the nozzles in some cases. For this reason, the flushing is performed after the suction purge to discharge any color mixture inks in the nozzles.

In each of the ink-jet recording apparatuses described in Japanese Patent Application Laid-Open No. 2008-260172 and Japanese Patent Application Laid-Open No. H10-258531, an ink discharge amount (hereinafter referred to as "flushing amount") in the flushing is not made to be uniform with respect to all the nozzles. The flushing amount is allowed to vary depending on types of inks to be jetted so as to effectively avoid the mixture of the plurality of color inks. In particular, in the ink-jet recording apparatus described in Japanese Patent Application Laid-Open No. 2008-260172, the flushing amount of the nozzles, from which the ink having high specific gravity is jetted, is made to be larger than the flushing amount of the nozzles, from which the ink having low specific gravity is jetted. Further, in the ink-jet recording apparatus described in Japanese Patent Application Laid-Open No. H10-258531, the higher the lightness of ink is, the larger the flushing amount is.

It has been known that, independently of the capping operation during the suction purge, the ink jetting surface is subjected to capping (capped) for protecting the nozzles and preventing the inks in the nozzles from being dried, when the ink jet head is not used (quiescent period of the ink jet head). The capping member used for these purposes is, normally, provided with an atmosphere communication port to prevent the capping member from being deformed and separated from the ink jetting surface and to prevent destruction of meniscus of ink formed in the nozzles, which would be otherwise caused by fluctuation of internal pressure in the cap member resulting from temperature change. An inner space of the capping member is communicated with the atmospheric air via the atmosphere communication port.

Thus, even when the nozzles are covered with the capping member during the quiescent period of the ink-jet head, since the inner space of the capping member is communicated with the atmospheric air, the drying of ink in the nozzles proceeds gradually. Therefore, the flushing (flushing before the use) is performed, immediately before the ink-jet head is started to use so as to discharge the viscosity-increased inks in the nozzles.

However, the present inventors have found out as follows. That is, humidity in the capping member is not uniform and there is humidity distribution in the capping member according to a distance from a suction port. The degree of progress of drying of ink (the degree of increase in viscosity) is varied in a plurality of nozzles according to the humidity distribution. Accordingly, if the flushing amount is made to be equal with respect to the plurality of nozzles, the inks are useless consumed for the nozzles in which the degree of the drying of ink is not severe.

In this regard, Japanese Patent Application Laid-Open No. 2008-260172 and Japanese Patent Application Laid-Open No. H10-258531 describe that the flushing amount is varied, in the flushing performed after the suction purge, according to the types of inks to be jetted. Japanese Patent-Application Laid-Open No. 2008-260172 and Japanese Patent Application Laid-Open No. H10-258531, however, fail to disclose that the flushing amount is varied, during the flushing before the use, according to differences in the degree of progress of the drying of ink among the plurality of nozzles covered with the capping member.

SUMMARY OF THE INVENTION

An object of the present invention is to suppress liquid consumption during a flushing by changing a flushing amount during a flushing before the use according to differences in the degree of progress of drying of ink among a plurality of nozzles covered with a capping member.

According to an aspect of the present teaching, there is provided a liquid droplet jetting apparatus which jets liquid droplets of a liquid, including: a liquid droplet jetting head which has a liquid droplet jetting surface on which a plurality of nozzles including a first nozzle and a second nozzle are open to jet the liquid droplets; a cap member which covers the liquid droplet jetting surface of the liquid droplet jetting head and in which an opening, through which an interior of the cap member is communicated with atmospheric air in a state that the liquid droplet jetting surface is covered with the cap member, is formed; a moving mechanism which moves the cap member to make contact with and separate from the liquid droplet jetting surface; and a controller which controls the liquid droplet jetting head and the moving mechanism, wherein the second nozzle is arranged farther than the first nozzle from the opening of the cap member in the state that the liquid droplet jetting surface is covered with the cap member; the controller controls the moving mechanism to separate the cap member covering the liquid droplet jetting surface from the liquid droplet jetting surface in a state that the interior of the cap member is communicated with the atmospheric air, and controls the liquid droplet jetting head to perform a flushing, in which the liquid droplets are jetted from the nozzles to discharge the liquid, such that a second discharge amount of the liquid to be discharged from the second nozzle is smaller than a first discharge amount of the liquid to be discharged from the first nozzle.

In this aspect of the present teaching, when the liquid droplet jetting head is not used (a quiescent period of the liquid droplet jetting head), the cap member is brought contact with the liquid droplet jetting surface to cover the openings of the nozzles (capping), in order to protect the nozzles and avoid drying of liquid in the nozzles. In this regard, however, an inner space of the cap member is maintained in a state of being communicated with the atmospheric air via the opening of the cap member. Thus, the drying of liquid in the plurality of nozzles proceeds gradually. When the liquid droplet jetting head is started to use in this state, the flushing (flushing before the use) is performed so as to discharge a thickened liquid in the nozzles, after the cap member is separated or away from the liquid jetting surface to release the openings of the nozzles.

Here, there is humidity distribution in the inner space of the cap member covering the openings of the nozzles, according to distance from the opening of the cap member communicated with the atmospheric air. Thus, the degree of progress of the drying of ink (the degree of increase in viscosity of liquid) varies between the nozzles having different distances from the opening of the cap member. That is, in the nozzles, the longer the distance from the opening of the cap member is, the smaller the degree of viscosity is. In view of this, the flushing amount in these nozzles is made to be small, thereby suppressing liquid consumption during the flushing before the use.

It is noted that "the distance from the opening of the cap member" does not indicate a so-called shortest distance in which the opening of the cap member is connected with the nozzle by a straight line, but a distance along with a channel in which the atmospheric air is allowed to actually flow between the opening of the cap member and the nozzle. Therefore, even if the nozzle is arranged at a position close to the opening of the cap member in the shortest distance, in a case that the length of the channel ranging from the opening of the cap member to the nozzle is long, for example, as in the case in which a complicated channel is formed in the cap member, the progress of the drying of liquid in the nozzle becomes slow. Accordingly, the flushing amount of the nozzle is set to be small.

DESCRIPTION OF THE PREFERRED EMBODIMENTS

Next, an embodiment of the present teaching will be explained.

Figure 1:
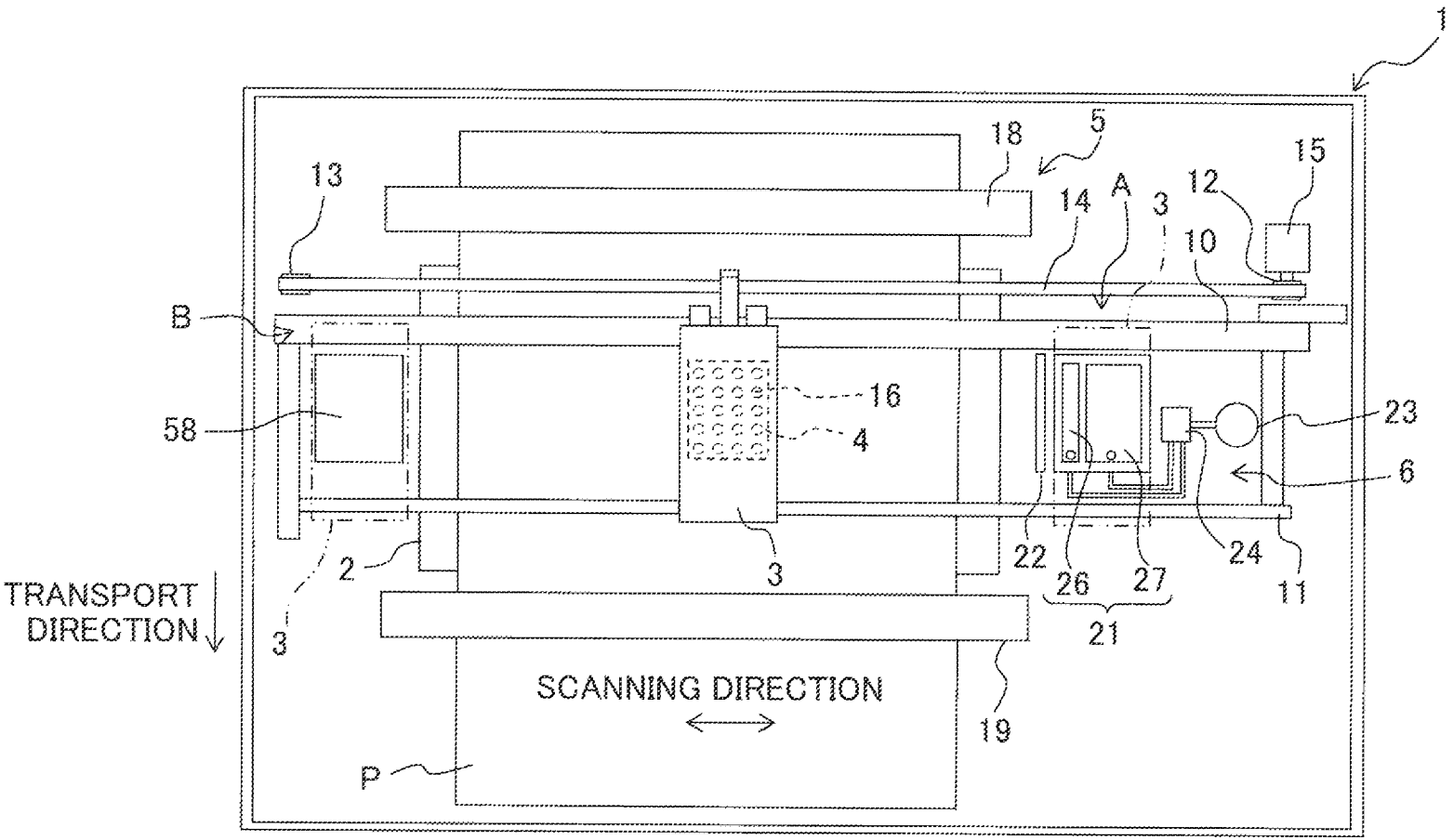
FIG. 1 is a plan view showing a schematic structure of an ink-jet printer according to this embodiment.

As shown in FIG. 1, an ink-jet printer 1 (liquid droplet jetting apparatus) includes, for example, a platen 2 on which a recording paper P is placed, a carriage 3 which is reciprocatively movable in the scanning direction parallel to the platen 2, an ink-jet head 4 (liquid droplet jetting head) which is carried on the carriage 3, a transport mechanism 5 which transports the recording paper P in the transport direction perpendicular to the scanning direction, a maintenance unit 6 which performs various maintenance operations in relation to the recovery and the maintenance for the liquid droplet jetting performance of the ink-jet head 4, and a control device 7 (controller; see FIG. 7) which is in charge of the control of the entire ink jet printer 1.

The recording paper P, which is supplied from an unillustrated paper feed mechanism, is placed on the upper surface of the platen 2. Two guide rails 10, 11, which extend in parallel in the left-right direction (scanning direction) as shown in FIG. 1, are provided over or above the platen 2. The carriage 3 is constructed to be reciprocatively movable in the scanning direction along the two guide rails 10, 11 in an area facing the platen 2. The two guide rails 10, 11 extend to the positions separated in the leftward direction and the rightward direction as shown in FIG. 1 along the scanning direction from the platen 2. The carriage 3 is constructed to be movable from the area (recording area) facing the recording paper P on the platen 2 to the positions separated in the left and right directions from the platen 2 as the non-recording area. Further, an endless belt 14, which is wound and applied between two pulleys 12, 13, is connected to the carriage 3. When the endless belt 14 is driven to travel by means of a carriage driving motor 15, the carriage 3 is moved in the scanning direction in accordance with the travel of the endless belt 14.

The ink-jet head 4 is attached to a lower portion of the carriage 3. The lower surface of the ink-jet head 4, which is parallel to the upper surface of the platen 2, is formed with an ink-jetting surface 4*a* (liquid droplet jetting surface, see FIGS. 4A and 4B and FIGS. 5A and 5B) on which a plurality of nozzles 16 are open. Inks are jetted from the plurality of nozzles 16 of the ink-jetting surface 4*a* toward the recording paper P placed on the platen 2.

Figure 2:
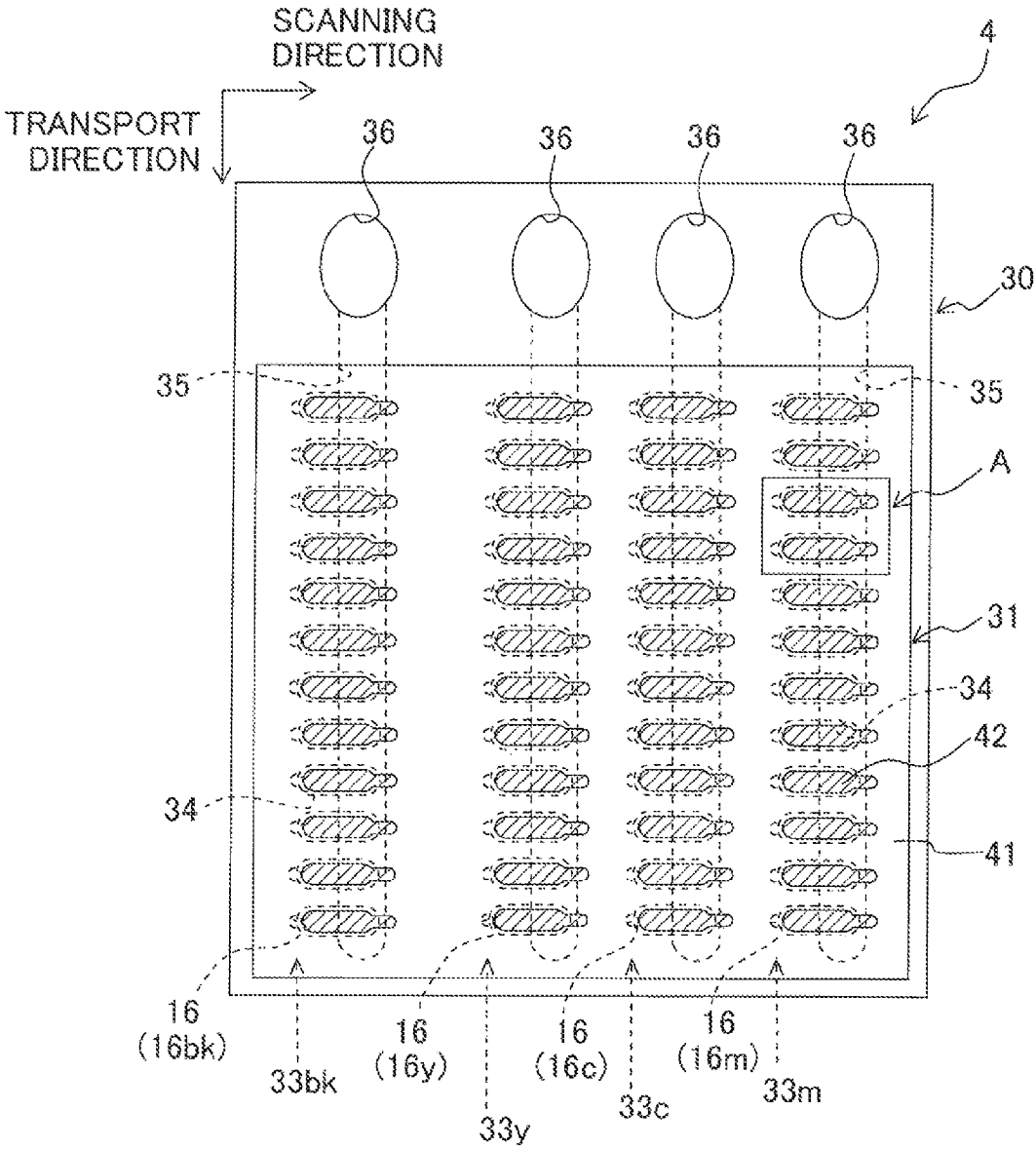
FIG. 2 is a plan view of an ink-jet head.
Figure 3A:
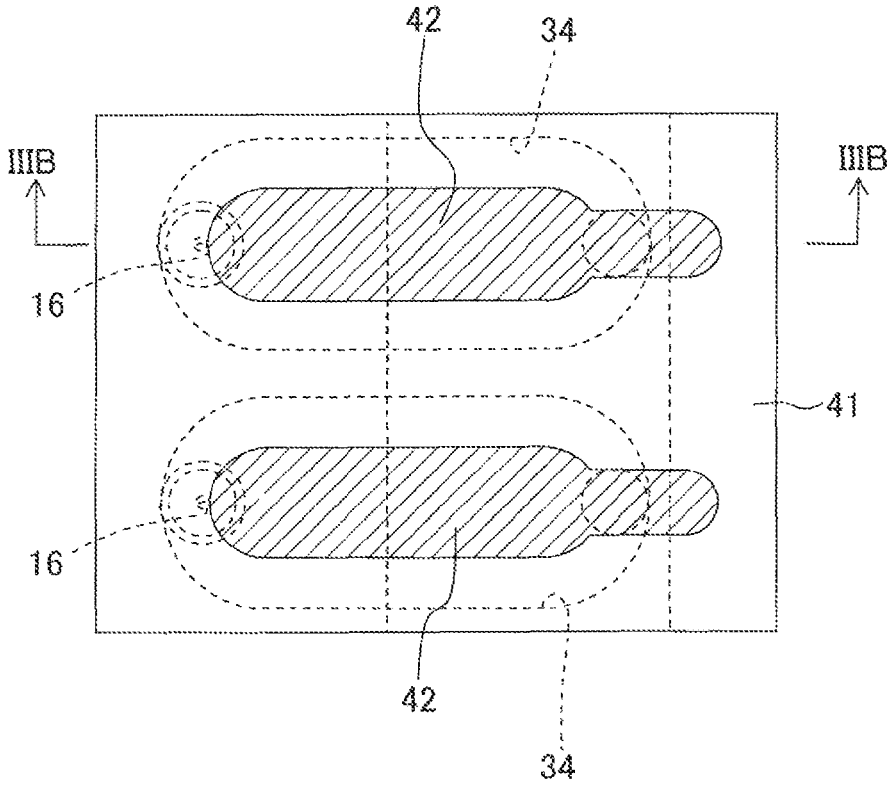
FIG. 3A is an enlarged view of a section A of FIG. 2.

The construction of the ink-jet head 4 will be specifically explained. As shown in FIGS. 2 and 3, the ink-jet head 4 includes a flow passage unit 30 which is formed with the plurality of nozzles 16 and a plurality of pressure chambers 34 communicated with the plurality of nozzles 16 respectively, and a piezoelectric actuator 31 which is arranged on the upper surface of the flow passage unit 30.

Figure 3B:
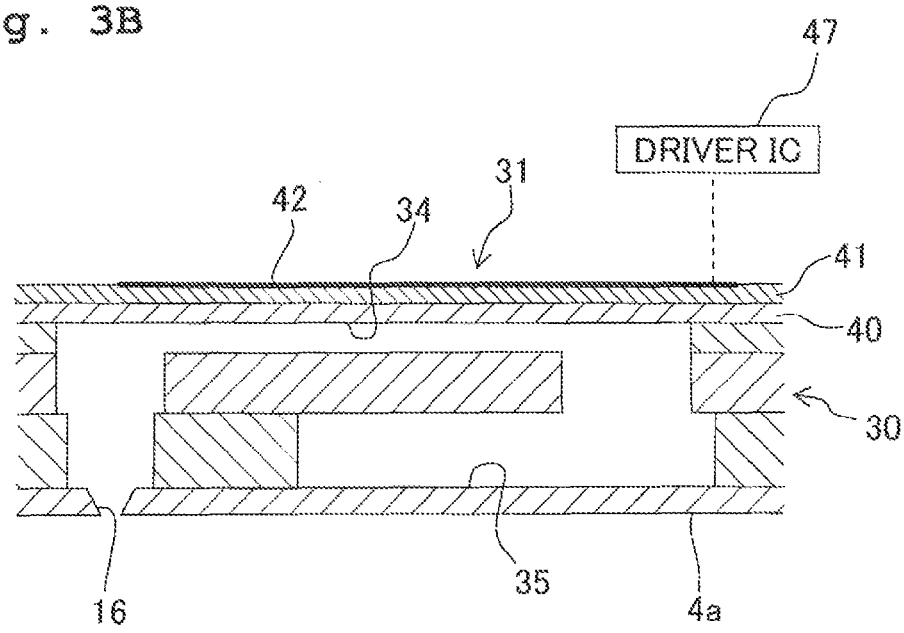
FIG. 3B is a sectional view taken along a line IIIB-IIIB of FIG. 3A.

As shown in FIG. 3B, the flow passage unit 30 has such a structure that four plates are stacked. The plurality of nozzles 16 are formed on the lower surface (ink-jetting surface 4*a*) of the flow passage unit 30. As shown in FIG. 2, the plurality of nozzles 16 are arranged in the transport direction to constitute four nozzle arrays 33 aligned in the scanning direction. The four color inks in total, i.e., the black ink as a pigment ink and the three color inks (yellow, cyan, magenta) as dye inks are jetted respectively from the nozzles 16 (16*bk*, 16*y*, 16*c*, 16*m*) belonging to the four nozzle arrays 33 (33*bk*, 33*y*, 33*c*, 33*m*) respectively.

The plurality of pressure chambers 34, which are communicated with the plurality of nozzles 16 respectively, are formed in the flow passage unit 30. Four arrays of the plurality of pressure chambers 34 are arranged as well corresponding to the four nozzle arrays 33. Further, the flow passage unit 30 is formed with four manifolds 35 which extend in the transport direction respectively and which supply the four color inks of black, yellow, cyan, and magenta to the four arrays of the pressure chambers. The four manifolds 35 are connected to four ink supply ports 36 which are formed on the upper surface of the flow passage unit 30.

As shown in FIG. 3B, the piezoelectric actuator 31 includes a vibration plate 40 which covers the plurality of pressure chambers 34, a piezoelectric layer 41 which is arranged on the upper surface of the vibration plate 40, and a plurality of individual electrodes 42 which are arranged corresponding to the plurality of pressure chambers 34 on the upper surface of the piezoelectric layer 41. The plurality of individual electrodes 42, which are positioned on the upper surface of the piezoelectric layer 41, are connected respectively to a driver IC 47 which drives the piezoelectric actuator 31. A predetermined driving voltage is independently applied from the driver IC 47 to the plurality of individual electrodes 42. The vibration plate 40, which is positioned on the lower surface of the piezoelectric layer 41, is formed of a metal material, and the vibration plate 40 plays a role of the common electrode which is opposed to the plurality of individual electrodes 42 with the piezoelectric layer 41 intervening therebetween. The vibration plate 40 is connected to the ground wiring line of the driver IC 47, and the vibration plate 40 is always held at the ground electric potential.

The piezoelectric actuator 31 is operated as follows. That is, when the predetermined driving voltage is applied from the driver IC 47 between a certain individual electrode 42 and the vibration plate 40 as the common electrode, then the volume change of the pressure chamber 34 is caused in accordance with the piezoelectric deformation (piezoelectric strain) of the piezoelectric layer 41 interposed between the both, and the pressure is applied to the ink contained in the pressure chamber 34. In this situation, the liquid droplets of the ink are jetted from the nozzle 16 communicated with the pressure chamber 34.

With reference to FIG. 1 again, the transport mechanism 5 has two transport rollers 18, 19 which are arranged to interpose the platen 2 in the transport direction. The recording paper P, which is placed on the platen 2, is transported in the transport direction (frontward direction as viewed in FIG. 1) by means of the two transport rollers 18, 19.

In the ink jet printer 1, the inks are jetted from the ink-jet head 4 which is reciprocatively moved in the scanning direction (left-right direction as shown in FIG. 1) together with the carriage 3 with respect to the recording paper P which is placed on the platen 2. Further, the recording paper P is transported in the transport direction (frontward direction as viewed in FIG. 1) by means of the two transport rollers 18, 19. Accordingly, the ink-jet printer 1 prints, for example, a desired image and/or letters on the recording paper P.

Next, the maintenance unit 6 will be explained. As shown in FIG. 1, the maintenance unit 6 is arranged at the position separated on one side (right side as shown in FIG. 1) in the scanning direction with respect to the platen 2 (maintenance position: Position A at which the carriage 3 is depicted by two-dot chain lines in FIG. 1). The maintenance unit 6 includes, for example, a cap member 21 which makes contact with the ink jetting surface 4*a* of the ink-jet head 4 to cover the openings of the plurality of nozzles 16 therewith, a suction pump 23 (purge mechanism) which is connected to the cap member 21, and a wiper 22 which wipes out the inks adhered to the ink-jetting surface 4*a* after the suction purge.

Figure 4:
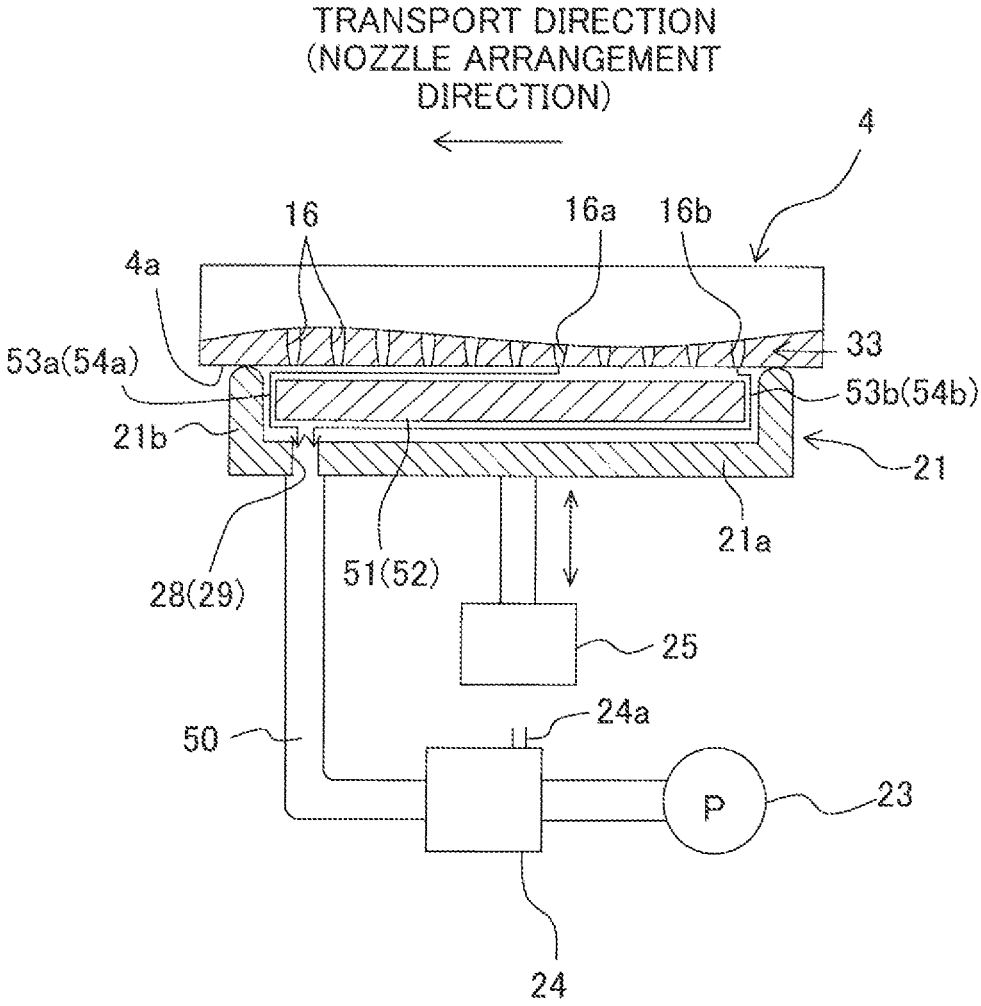
FIG. 4 is a sectional view in relation to the vertical plane including the transport direction to illustrate a cap member in a capping state.
Figure 5:
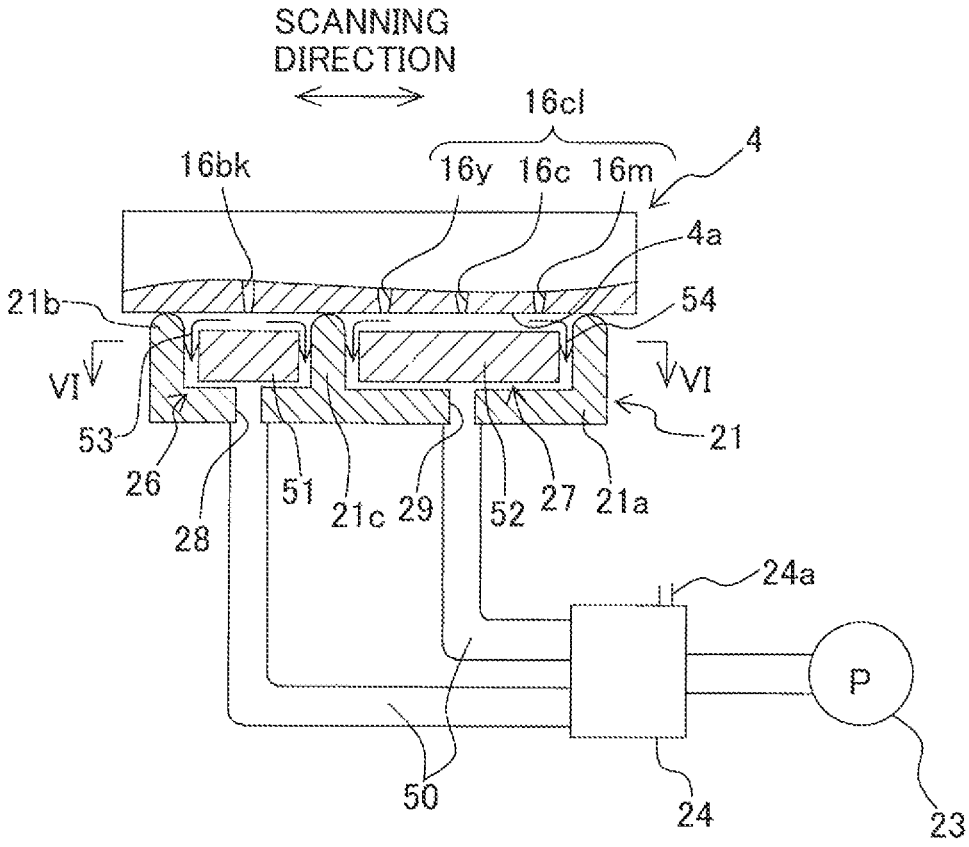
FIG. 5 is a sectional view in relation to the vertical plane including the scanning direction to illustrate the cap member in the capping state.
Figure 6:
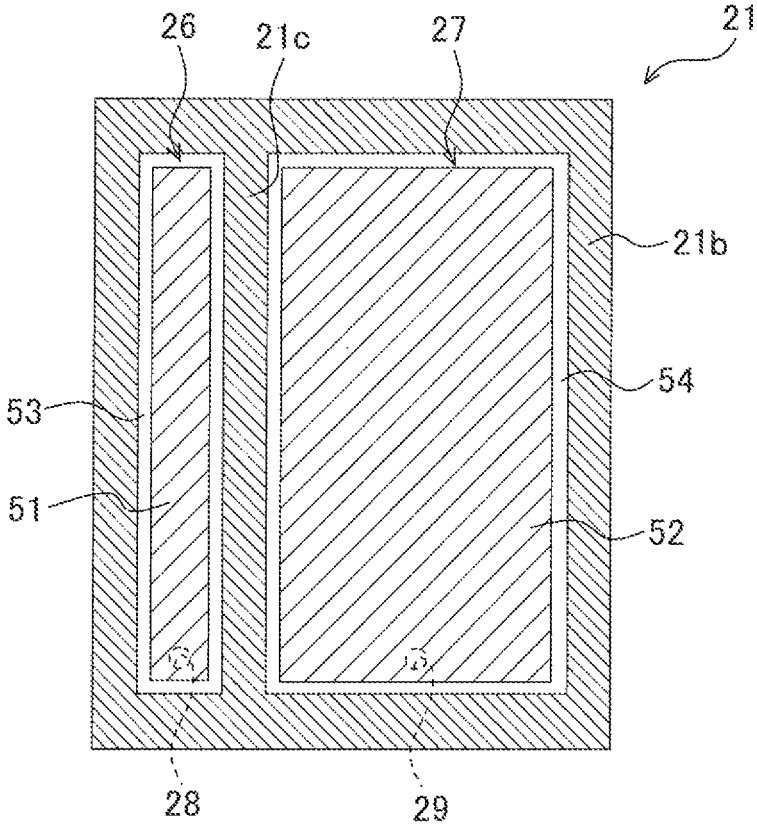
FIG. 6 is a sectional view taken along a line VI-VI of FIG. 5.

As shown in FIG. 4, FIG. 5, and FIG. 6, the cap member 21 has a bottom wall section 21*a*, and a lip section 21*b* which is provided at an outer circumferential portion of the bottom wall section 21*a*. The inner space of the cap member 21 surrounded by the lip section 21*b* is partitioned by a partition wall 21*c* to thereby form a first cap section 26 which has a size to cover the plurality of black nozzles 16*bk* constructing one array of the nozzle array 33*bk* and a second cap section 27 which covers the plurality of color nozzles 16*cl* (16*y*, 16*c*, 16*m*) constructing the three arrays of the color nozzle arrays 33*y*, 33*c*, 33*m*.

The cap member 21 is driven up and down (vertically) by the cap driving mechanism 25 (moving mechanism) including a driving means, such as a motor. The cap member 21 is driven to make approach/separation with respect to the ink jetting surface 4*a*. When the cap member 21 is brought in contact with the ink-jetting surface 4*a*, the first cap section 26 covers the black nozzles 16*bk* and the second cap section 27 covers the three color nozzles 16*cl*. In FIG. 5, the cap driving mechanism 25 shown in FIG. 4 is omitted.

As shown in FIG. 4, suction ports (openings) 28, 29 are respectively formed at first end positions (end positions disposed on the downstream side in the transport direction) in the arrangement direction of the respective nozzles, of the bottom wall portion of the first cap section 26 and the bottom wall portion of the second cap section 27. As shown in FIG. 5, in the scanning direction, the suction ports 28, 29 are respectively formed at the center portions of the bottom wall portions of the cap sections 26, 27. The two suction ports 28, 29 are connected to a switching unit 24 by tubes 50 respectively. Further, the switching unit 24 is connected to the suction pump 23. The switching unit 24 has a switching valve (not shown) disposed therein. As shown in FIG. 5, when the cap member 21 is in the capping state, the switching unit 24 allows the suction pump 23 to be communicated with any one of the first cap section 26 and the second cap section 27. In this state, the interior of the cap section 26 (27) allowed to be in communication is subjected to the suction by means of the suction pump 23 and the pressure in the cap section 26(27) is reduced. Accordingly, the ink I is discharged from the nozzles 16 covered with the cap section 26 (27). That is, the suction purge is individually performed for the black nozzles 16*bk* and the color nozzles 16*cl*.

Cap chips 51, 52 are respectively accommodated in the first cap section 26 and the second cap section 27 of the cap member 21. As shown in FIG. 6, each of the cap chips 51, 52 is a plate-shaped member which is rectangular. The size of each of the cap chips 51, 52, in a plan view, is smaller to some extent than that of each of the cap sections 26, 27, in which each of the cap chips 51, 52 is accommodated. As described above, since the cap chips 51, 52 are respectively accommodated in the two cap sections 26, 27, deformation of the cap member 21 due to reduction of pressure during the suction purge can be avoided. As shown in FIG. 4 and FIG. 5, when the cap member 21 is in the capping state, channels 53, 54 which are indicated by arrows and which extend from the openings of the nozzles 16 to the suction ports 28, 29 respectively, are formed between the inner surface of the first cap section 26 of the cap member 21 and the cap chip 51 and between the inner surface of the second cap section 27 of the cap member 21 and the cap chip 52, respectively.

When the suction purge is completed, the cap member 21 is driven downwardly by the cap driving mechanism 25 and the cap member 21 is separate from the ink-jetting surface 4*a*. Then, the inks accumulated in the cap sections 26, 27 are sucked and discharged by the suction pump 23. In this situation, due to the effect of capillary force, the inks are more likely to remain at the corners of the cap sections 26, 27 without being sucked. This embodiment, however, adopts a construction in which the inks accommodated in the cap sections 26, 27 are reliably discharged.

At first, the suction ports 28, 29 of the cap sections 26, 27 are respectively formed at first end portions of the bottom wall portion of the cap member 21. When the cap member 21 is in the capping state, the suction ports 28, 29 are opposed to the nozzles 16 placed at the first end positions (left side in FIG. 4) in the arrangement direction of the respective nozzles of the plurality of nozzles 16. In this case, the suction ports 28, 29 are placed in the vicinities of the corners of the cap member 21. Accordingly, as compared with the case in which the suction ports 28, 29 are provided at the center portions of the cap sections 26, 27 respectively, the inks accumulated at the corners of the cap sections 26, 27 are easily sucked from the suction ports 28, 29.

Further, the cap chips 51, 52 are accommodated in the cap sections 26, 27 respectively. As shown in FIG. 4, FIG. 5, and FIG. 6, narrow channels (gaps) 53, 54 leading to the suction ports 28, 29 respectively are formed between the inner surface of the cap section 26 and the cap chip 51 and between the inner surface of the cap section 27 and the cap chip 52. These channels 53, 54 serve as channels when the inks discharged from the nozzles 16 by the suction purge are allowed to flow to the suction ports 28, 29, respectively. Since strong capillary force acts on the inks in these narrow channels 53, 54, waste inks remained at the corners of the cap sections 26, 27 are easily sucked to the suction ports 28, 29, respectively.

In this embodiment, other than the suction purge described above, the cap member 21 is also used in a quiescent period of the ink-jet head 4 during which the ink-jet head 4 is not used (the state that no ink is jetted from the ink-jet head 4). The cap member 21 is brought in contact with the ink-jetting surface 4*a* to cover the openings of the nozzles 16 therewith during the quiescent period of the ink-jet head 4. By doing so, the nozzles 16 are protected, and the inks contained in the nozzles 16 are suppressed from being dried.

Further, in this embodiment, the switching unit 24 has an atmosphere communication section 24*a*. When the ink-jet head 4 is in the quiescent period (i.e. capping state), the space in the cap member 21 is communicated with the atmospheric air via the two suction ports 28, 29 and the atmosphere communication section 24*a* of the switching unit 24. Accordingly, the cap member 21 is prevented from being deformed and a part thereof is prevented from being separated from the ink jetting surface 4*a*, which would be otherwise caused by the fluctuation of the internal pressure in the cap member 21 resulting from the external temperature change. That is, the switching unit 24 corresponds to the switching mechanism of the present invention which performs the switching or changeover between the suction purge enabled state in which the suction ports 28, 29 of the cap member 21 are connected to the suction pump 23 and the atmospheric air communicated state in which the suction ports 28, 29 of the cap member 21 are communicated with the atmospheric air.

With reference to FIG. 1 again, the wiper 22 is provided upstandingly at the position deviated toward the platen 2 as compared with the cap member 21. The carriage 3 is moved in the scanning direction in a state in which the forward end of the wiper 22 is brought in contact with the ink-jetting surface 4*a* after the suction purge. Accordingly, the wiper 22 is moved relatively with respect to the ink-jetting surface 4*a*, and the inks, which are adhered to the ink-jetting surface 4*a*, are wiped out (hereinafter also referred to as wiping).

Further, the printer 1 of this embodiment is constructed to perform the flushing so that the inks are discharged by jetting the inks from the nozzles 16 of the ink-jet head 4 at the appropriate timing. As shown in FIG. 1, a liquid receiving member 58 is provided at a position disposed on the side opposite to the maintenance unit 6 with the platen 2 intervening therebetween (flushing position: Position B at which the carriage 3 is depicted by two-dot chain lines in FIG. 1). The ink-jet head 4 performs the flashing after the carriage 3 is moved to the flashing position B. The inks discharged from the nozzles 16 in accordance with the flashing are received by the liquid receiving member 58.

In this embodiment, the flushing (flushing after the purge) is performed immediately after the completion of the series of maintenance, such as the suction purge, performed by the maintenance unit 6. Parts of waste inks, which are discharged by the suction purge, are adhered to the ink jetting surface 4*a*. The waste inks are sucked into the nozzles 16 by the back pressure in the ink jet head 4 when the cap member 21 is separated and away from the ink-jetting surface 4*a*. Therefore, the flushing is performed to discharge the waste inks sucked into the nozzles 16, after the suction purge is performed, the cap member 21 is separated and away from the ink-jetting surface 4*a*, and the wiping by the wiper 22 is performed.

The nozzles 16 are covered with the cap member 21 during the quiescent period of the ink-jet head 4. However, since the interior portion of cap member 21 is in a state of being communicated with the atmospheric air, the drying of ink (increase in viscosity) arises in the nozzles 16. In view of the above, in order to discharge the viscosity-increased ink from the nozzles 16, the flushing (flushing before the use) is performed before the start of use of the ink jet head 4.

Figure 7:
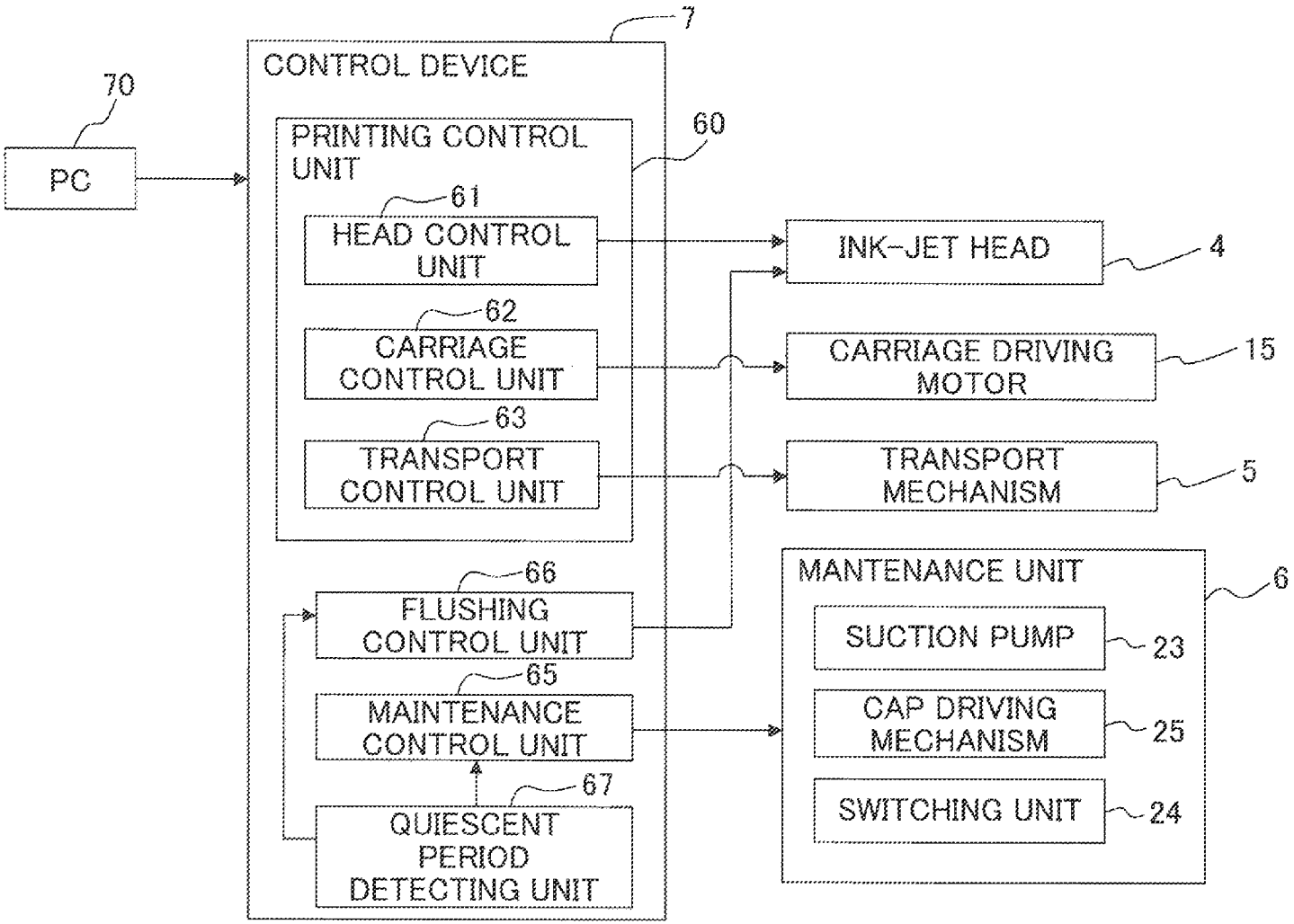
FIG. 7 is a block diagram schematically showing a control system of the printer.

Next, an explanation will be made in detail with reference to a block diagram shown in FIG. 7 about the control system of the ink jet printer 1 including the control device 7 (controller) as a main device. The control device 7 of the printer 1 shown in FIG. 7 includes a microcomputer including, for example, CPU (Central Processing Unit), ROM (Read Only Memory) which stores, for example, various programs and data for controlling the overall operation of the printer 1, and RAM (Random Access Memory) which temporarily stores, for example, data to be processed by CPU. The program stored in ROM is executed by CPU, and thus various control operations are performed as explained below. Alternatively, the control device 7 may be based on a hardware in which various circuits including a calculation circuit are combined.

The control device 7 has a printing control unit 60 including a head control unit 61 which controls the ink-jet head 4, a carriage control unit 62 which controls the carriage driving motor 15 for driving the carriage 3 in the scanning direction, and a transport control unit 63 which controls the transport mechanism 5. The printing control unit 60 controls the ink-jet head 4, the carriage driving motor 15, and the transport mechanism 5 respectively on the basis of the data (printing data) which relates, for example, to an image to be printed and which is inputted from PC (Personal Computer) 70 so that the printing is performed on the recording paper P.

The control device 7 further includes a maintenance control unit 65 which controls the suction pump 23 of the maintenance unit 6 and a driving mechanism of the cap driving mechanism 25, such as a motor, for moving the cap member 21 upwardly/downwardly, to control the series of maintenance operation including the suction purge as described above, and a flushing control unit 66 which controls the flushing of the ink jet head 4.

The control device 7 further includes a quiescent period detecting unit 67. When the ink-jet head 4 is used upon a receipt of a print command from the PC 70, the quiescent period detecting unit 67 detects a period during which the capping is performed by the cap member 21, that is, the quiescent period detecting unit 67 detects the quiescent period of the ink-jet head 4. It is possible to adopt various techniques for detecting the quiescent period of the ink-jet head 4 by the quiescent period detecting unit 67. For example, it is possible to detect the quiescent period in accordance with the timing of a separating/approaching driving of the cap member 21 in the quiescent state of the ink-jet head 4 (i.e. times at which the capping and the cap release are performed), the timing of the separating/approaching driving of the cap member 21 being controlled by the maintenance control unit 65.

In a case that the quiescent period of the ink-jet head 4 is short, the viscosity of ink is not increased severely. Thus, it is possible to discharge the viscosity-increased ink by the flushing. In view of the above, in a case that the quiescent period detected by the quiescent period detecting unit 67 does not exceed a predetermined period (for example, a period about a week), the flushing control unit 66 makes the ink-jet head 4 perform the flushing before the use. Further, as described later on, the flushing control unit 66 performs the control for changing the flushing amount of each of the nozzles 16 in accordance with the quiescent period of the ink-jet head 4. On the other hand, in a case that the quiescent period exceeds the predetermined period, the maintenance control unit 65 makes the maintenance unit 6 perform the suction purge to thereby discharge the viscosity-increased ink in the nozzles 16 by the suction purge.

The respective functions of the head control unit 61, the carriage control unit 62, the transport control unit 63, the maintenance control unit 65, the flushing control unit 66, and the quiescent period detecting unit 67, described above, are realized, actually, by the operation of the microcomputer constructing the control device 7 or the operation of various circuits including an arithmetic circuit.

Next, an explanation will be made about the flushing control of the ink-jet head 4 by the flushing control unit 66.

At first, after the completion of the series of maintenance operation including, for example, the suction purge by the maintenance unit 6 and the wiping performed after the suction purge, the flushing control unit 66 makes the ink-jet head 4 perform the flushing (flushing after the purge) so as to discharge the waste ink sucked into the nozzles 16.

Further, when the ink-jet head 4 is started to use upon the receipt of the print command after the quiescent period of the ink-jet head 4, the flushing control unit 66 makes the ink jet head 4 perform the flushing (flushing before the use) so as to discharge the ink, the viscosity of which is increased during the quiescent period of the ink-jet head 4, from the nozzles 16.

Here, when the ink-jet head 4 is in the quiescent period, the cap member 21 comes into contact with the ink jetting surface 4*a* to cover the nozzles 16 with the cap member 21 (cap sections 26, 27). However, as described above, the suction ports 28, 29 of the two cap sections 26, 27 of the cap member 21 are communicated with the atmospheric air via the switching unit 24. Therefore, there is humidity distribution, depending on the distance from each of the suction ports 28, 29 in each of the two capping sections 26, 27. Therefore, in the nozzles 16 covered with the cap section 26 (27), as the distance from the suction port 28 (29) to the nozzle 16 is longer, that is, as the length of the channel extending from the suction port 28 (29) to the nozzle 16 is longer, the progress of the drying of ink becomes slower, and the degree of increase in viscosity of ink becomes smaller.

In particular, the distance from the suction port 28 (29) to the nozzle 16 (first nozzle), which is arranged on one end side of the nozzle array 33 (left side in FIG. 4) and which is opposed to the suction port 28 (29), is short. Thus, the humidity in the vicinity of the opening of this nozzle 16 is low and the drying of ink in this nozzle 16 is rapidly progressed. On the other hand, the distance from the suction port 28 (29) to the nozzle 16 (second nozzle) which is arranged on other end side of the nozzle array 33 (right side in FIG. 4) is long. Thus, the humidity in the vicinity of the opening of this nozzle 16 is high and the drying of ink in this nozzle 16 is slowly progressed.

As shown in FIG. 4, in a case that the cap chip 51(52) is accommodated in the cap section 26 (27), the narrow channel (gap) 53 (54) indicated by arrows is formed around the cap chip 51 (52). Here, "the distance from the suction port to the nozzle" described above is not the so-called shortest distance in which the suction port 28 (29) is connected with the nozzle 16 by a straight line, but the distance along with the channel 53 (54) in which the atmospheric air is allowed to flow between the suction port 28 (29) and the nozzle 16. Therefore, for example, with respect to the shortest distance (straight-line distance), the distance from the suction port 28 (29) to a nozzle 16*a* arranged at the central portion in the direction in which the nozzle array 33 is aligned is shorter than the distance from the suction port 28 (29) to a nozzle 16*b* arranged at a right end in the diagram, of the nozzle array 33. However, the cap chip 51 (52) is interposed between each of the nozzles 16*a*, 16*b* and the suction port 28 (29). Thus, with respect to the distance along with the outer circumference of the cap chip 51 (52), that is, the distance along with the channel 53 (54), the distance from the suction port 28 (29) to the nozzle 16*a* is longer than the distance from the suction port 28 (29) to the nozzle 16*b*. Namely, a channel 53*a* (54*a*) (second channel) extending from the nozzle 16*a* to the suction port 28 (29) is longer than a channel 53*b* (54*b*) (first channel) extending from the nozzle 16*b* to the suction port 28 (29). Therefore, the humidity in the vicinity of the opening of the nozzle 16*a* is still higher than the humidity in the vicinity of the opening of the nozzle 16*b* arranged at the right end in FIG. 4, and the drying of ink in the nozzle 16*a* is slowly progressed.

Further, as shown in FIG. 5, with respect to the three color nozzles 16*cl* covered with the second cap section 27, the centrally-placed cyan nozzle 16*c* is facing the suction port 29, and is arranged at the position closest to the suction port 29 in the straight-line distance. However, with respect to the distance along with the channel 54, the cyan nozzle 16*c* is arranged at the position farther than the yellow nozzle 16*y* and the magenta nozzle 16*m* from the suction port 29. The drying of ink in the cyan nozzle 16*c* is slowly progressed.

The flushing control unit 66 controls the flushing amount as follows. That is, the flushing amount is not made to be uniform with respect to all the nozzles 16. As the distance from the suction port 28 (29) to the nozzle 16 is longer (as the length of the channel extending from the suction port 28 (29) to the nozzle 16 is longer), the flushing amount is made to be smaller. By doing so, it is possible to suppress the ink consumption during the flushing before the use. In order that the respective nozzles 16 have the different flashing amounts, such a technique is appropriately adopted that the number of times of execution of the flashing (number of times of continuous jetting) is changed or the amount of liquid droplets jetted in a single flashing is changed.

Further, in this embodiment, since the cap chip 51 (52) is accommodated in the cap section 26 (27), the ink jetting surface 4*a* on which the openings of the plurality of nozzles 16 are formed is in a state of facing the cap chips 51 (52), as shown in FIG. 4 and FIG. 5. Further, since the channel 53 (54) between the suction port 28 (29) and each of the nozzles 16 is complicated (narrow and long), the drying of ink in each of the nozzles 16 can be suppressed. Furthermore, when the channel 53 (54) is complicated, there is generated great differences in the progress of the drying of ink between the nozzles 16 having different distances from the suction port 28 (29) (different lengths of the channel in which the atmospheric air is actually allowed to flow). In other words, when the cap chip 51 (52) is provided in the cap member 21 and when the flushing amount is varied depending on the distance from the suction port 28 (29) as described above, the effect to suppress the ink consumption during the flushing is significantly improved.

As described above, as the quiescent period of the ink jet head 4 (capping period by the cap member 21) detected by the quiescent period detecting unit 67 is longer, the flushing control unit 66 makes the flushing amount larger. In this regard, even when the quiescent period is long, the degree of progress of the drying of ink does not significantly change in the nozzle 16 having a long distance from the suction port 28 (29), as compared with the nozzle 16 having a short distance from, the suction port 28 (29). In view of the above, when the flushing amount is increased depending on the quiescent period of the ink-jet head 4, the nozzle 16 having a longer distance from the suction port 28 (29) is set to have an increment of the flushing amount in a smaller amount.

For example, a case, in which the flushing amount is varied in accordance with the number of times of execution of the flashing, is taken into consideration. Here, with respect to the nozzle at the position closest to the suction port and the nozzle at the position farthest from the suction port, it is possible to set the increment of the flushing amount in accordance with the quiescent period, as follows.

Nozzle at the Position Closest to the Suction Port

The flushing amount in a case that the quiescent period is a single day: 20 shots The increment of flushing in a case that the quiescent period is increased by one day: 10 shots Nozzle at the Position Farthest from the Suction Port The flushing amount in a case that the quiescent period is a single day: 10 shots The increment of flushing in a case that the quiescent period is increased by one day: 3 shots In the case described above, when the quiescent period is three days, the flushing amount (the number of times of execution of the flashing) of each of the nozzles is as follows.

Nozzle at the Position Closest to the Suction Port:

$$20 \text{ shots}+10 \text{ shots}\times(3-1)=40 \text{ shots}$$

Nozzle at the Position Farthest from the Suction Port:

$$10 \text{ shots}+3 \text{ shots}\times(3-1)=16 \text{ shots}$$

The amount of liquid droplets jetted in the single flushing may be varied between the nozzle at a position close to the suction port and the nozzle at a position far from the suction port. In that case, the amount of liquid droplets jetted in the single flushing may be set, for example, as follows. That is, the liquid droplets of 10 pl are jetted from the first nozzle at the position close to the suction port, the liquid droplets of 3 pl are jetted from the second nozzle at the position far from the suction port, and the liquid droplets of 5 pl are jetted from the nozzle at the position between the first nozzle and the second nozzle.

Next, modified embodiments in which the above-described embodiment is variously modified will be explained. However, components having the structures similar to those of the above-described embodiment will be denoted by the same reference numerals and symbols, and explanation thereof will be omitted when appropriate.

In the above described embodiment, the suction ports 28, 29 are respectively formed at first end positions (end positions disposed on the downstream side in the transport direction) in the arrangement direction of the respective nozzles, of the bottom wall portion of the first cap section 26 and the bottom wall portion of the second cap section 27. However, the suction ports 28, 29 may be respectively formed at second end positions (end positions disposed on the upstream side in the transport direction) in the arrangement direction of the respective nozzles, of the bottom wall portion of the first cap section 26 and the bottom wall portion of the second cap section 27.

Figure 8:
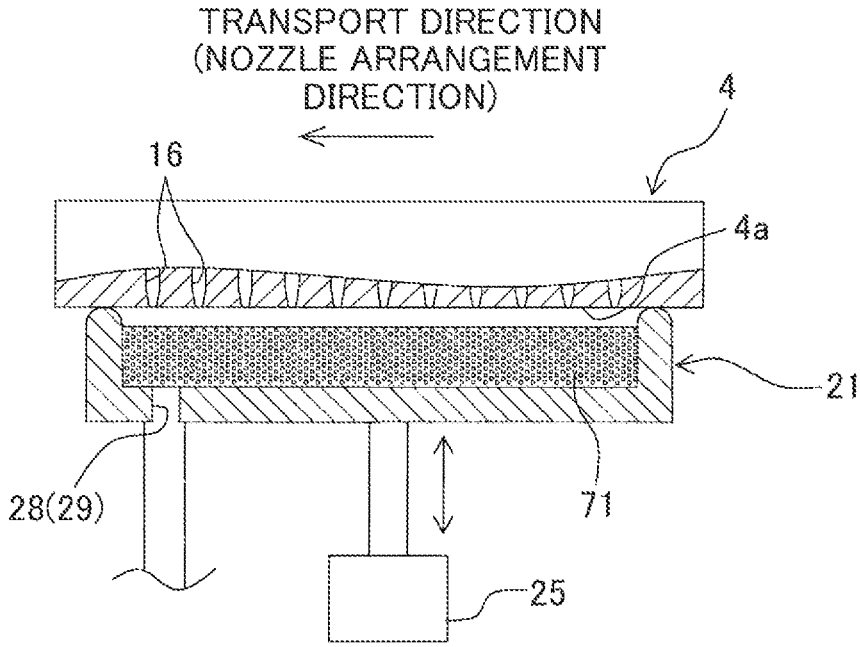
FIG. 8 is a sectional view in relation to the vertical plane including the transport direction to illustrate a cap member in a capping state according to a modified embodiment.

As shown in FIG. 8, a foam 71 made of a porous member may be accommodated in the cap member 21. In this embodiment, the nozzles 16 are connected to the suction port 28 (29) by complicated channels made of a number of holes formed in the foam 71. Thus, the drying of ink in the nozzles 16 is hardly caused as a whole. However, it is easily understood that, even in this case, the drying of ink is further restrained in the nozzle 16 at the position far from the suction port 28 (29), as compared with the nozzle 16 at the position close to the suction port 28 (29). In view of this, as in the above embodiment, as the distance from the suction port 28 (29) to the nozzle 16 is longer, the flushing amount is made to be smaller.

Figure 9:
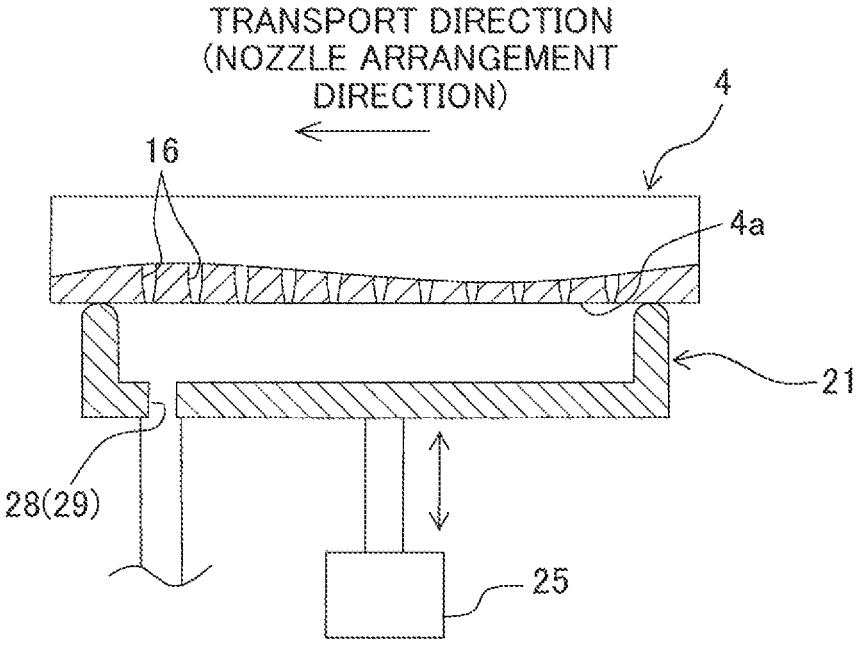
FIG. 9 is a sectional view in relation to the vertical plane including the transport direction to illustrate a cap member in a capping state according to another modified embodiment.

As shown in FIG. 9, the present teaching is also applicable in an embodiment in which the cap chips 51, 52 (FIG. 4, FIG. 5), the foam 71 (FIG. 8), or the like is not accommodated in the cap member 21. In that case, there is no inclusion between the nozzles 16 and suction port 28 (29). Thus, as the distance from the suction port 28 (29) to the nozzle 16 in the straight-line distance is longer, the flushing amount is made to be smaller.

Figure 10:
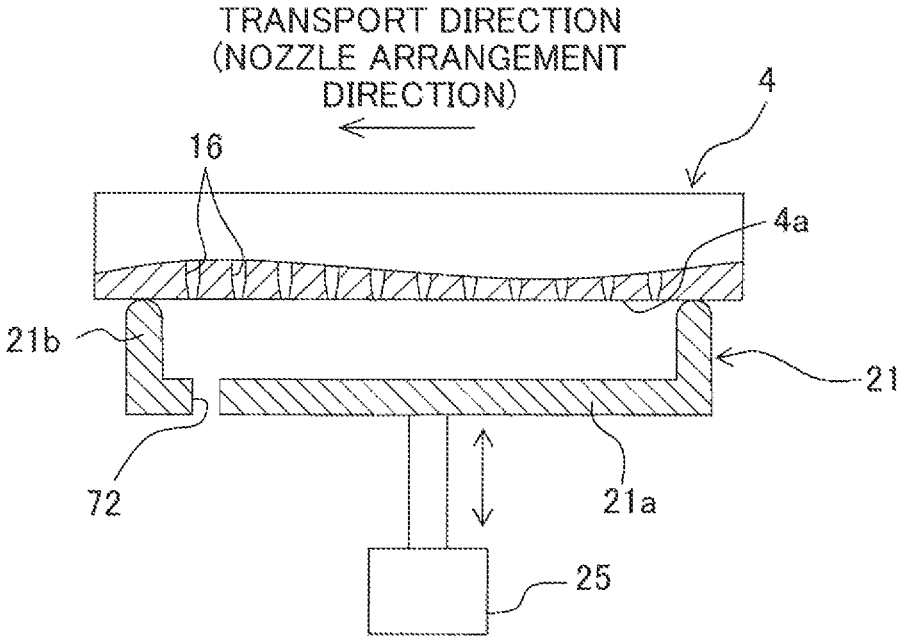
FIG. 10 is a sectional view in relation to the vertical plane including the transport direction to illustrate a cap member in a capping state according to still another modified embodiment.

The cap member 21 of the above embodiment is connected to the suction pump 23 and serves as the cap member for the suction purge. However, as shown in FIG. 10, the cap member 21 may be a cap which is not connected to the suction cap 23 and is exclusively for protection of the nozzles and prevention of the drying. Also in this case, in order to avoid the fluctuation of internal pressure during the capping state, an atmosphere communication port 72 is formed in the cap member 21, and the inner space of the cap member 21 in the capping state is communicated with the atmospheric air. As the distance from the atmosphere communication port 72 to the nozzle 16 is longer, the flushing amount in the flushing before the use is made to be smaller. The position at which the atmosphere communication port 72 is formed is not limited to an end portion of the bottom wall section 21*a* of the cap member 21 shown in FIG. 10. The atmosphere communication port 72 may be formed at the central portion of the bottom wall section 21*a* of the cap member 21. Alternatively, the atmosphere communication port 72 may be formed at the lip section 21*b*.

In the above embodiment, as shown in FIG. 5, the black nozzle 16*bk* and the three color nozzles 16*cl* are covered with the cap sections 26, 27, respectively. However, it is allowable that the four types of nozzles 16 are commonly covered with a single cap member 21. Or, it is allowable that the inner space of the cap member 21 is partitioned by three partition walls 21*c* to cover the four types of nozzles 16 with four cap sections respectively.

The embodiment and the modified embodiments described above are applied to the ink-jet printer. The present teaching, however, is also applicable to liquid droplet jetting apparatuses used in various fields, because the problem of drying of ink in the nozzle during the quiescent period of the ink-jet head may be caused in liquid droplet jetting apparatuses used in application other than an image record.

What is claimed is:

1. A liquid droplet jetting apparatus which jets liquid droplets of a liquid, comprising:

a liquid droplet jetting head which has a liquid droplet jetting surface on which a plurality of nozzles including a first nozzle and a second nozzle are open to jet the liquid droplets;

a cap member which covers the liquid droplet jetting surface of the liquid droplet jetting head and in which an opening, through which an interior of the cap member is communicated with atmospheric air in a state that the liquid droplet jetting surface is covered with the cap member, is formed;

a moving mechanism which moves the cap member to make contact with and separate from the liquid droplet jetting surface;

a quiescent period detecting unit which detects a quiescent period of the liquid droplet jetting head during which the plurality of nozzles of the liquid droplet jetting head are covered with the cap member in the state that the interior of the cap member is communicated with the atmospheric air; and a controller which controls the liquid droplet jetting head and the moving mechanism;

wherein the second nozzle is arranged farther than the first nozzle from the opening of the cap member in the state that the liquid droplet jetting surface is covered with the cap member;

wherein the controller controls the moving mechanism to separate the cap member coveting the liquid droplet jetting surface from the liquid droplet jetting surface in a state that the interior of the cap member is communicated with the atmospheric air, and controls the liquid droplet jetting head to perform a flushing, in which the liquid droplets are jetted from the nozzles to discharge the liquid, such that a second discharge amount of the liquid to be discharged from the second nozzle is smaller than a first discharge amount of the liquid to be discharged from the first nozzle;

wherein the controller controls the liquid droplet jetting head to perform the flushing such that a discharge amount of the liquid, which is to be discharged from each of the plurality of nozzles during the flushing and corresponds to a first quiescent period detected by the quiescent period detecting unit, is greater than another discharge amount of the liquid, which is to be discharged from each of the plurality of nozzles during the flushing and corresponds to a second quiescent period shorter than the first quiescent period and detected by the quiescent period detecting unit; and wherein the controller controls the liquid droplet jetting head such that a second increment of the second discharge amount of the liquid with respect to a predetermined quiescent period is smaller than a first increment of the first discharge amount of the liquid with respect to the predetermined quiescent period.

2. The liquid droplet jetting apparatus according to claim 1, further comprising:

a suction mechanism which is connected to the opening of the cap member and performs a suction purge, in which the liquid is discharged from the plurality of nozzles by sucking the interior of the cap member, in a state that the cap member is brought in contact with the liquid droplet jetting surface; and a switching mechanism which switches the opening of the cap member between in a first state in which the opening of the cap member is connected to the suction mechanism and in a second state in which the opening of the cap member is communicated with the atmospheric air.

3. The liquid droplet jetting apparatus according to claim 1;

wherein the plurality of nozzles are aligned in a predetermined arrangement direction;

wherein the opening of the cap member is formed at a position at which the opening of the cap member is opposed to a nozzle, which is formed on one end side in the arrangement direction in the state that the cap member is brought in contact with the liquid droplet jetting surface; and wherein the first nozzle is arranged on the one end side in the arrangement direction and the second nozzle is arranged on the other end side in the arrangement direction.

4. The liquid droplet jetting apparatus according to claim 1;

wherein the cap member further comprises a plate-shaped cap chip which is accommodated in the cap member and prevents a deformation of the cap member during the suction purge.

5. The liquid droplet jetting apparatus according to claim 4;

wherein a planar size of the cap chip is smaller than a size of a bottom surface of the cap member.

6. A liquid droplet jetting apparatus which jets liquid droplets of a liquid, comprising:

a liquid droplet jetting head which has a liquid droplet jetting surface on which a plurality of nozzles including a first nozzle and a second nozzle are open to jet the liquid droplets;

a cap member which covers the liquid droplet jetting surface of the liquid droplet jetting head and in which an opening, through which an interior of the cap member is communicated with atmospheric air in a state that the liquid droplet jetting surface is covered with the cap member, is formed;

a moving mechanism which moves the cap member to make contact with and separate from the liquid droplet jetting surface; and a controller which controls the liquid droplet jetting head and the moving mechanism;

wherein the second nozzle is arranged farther than the first nozzle from the opening of the cap member in the state that the liquid droplet jetting surface is covered with the cap member;

wherein the controller controls the moving mechanism to separate the cap member covering the liquid droplet jetting surface from the liquid droplet jetting surface in a state that the interior of the cap member is communicated with the atmospheric air, and controls the liquid droplet jetting head to perform a flushing, in which the liquid droplets are jetted from the nozzles to discharge the liquid, such that a second discharge amount of the liquid to be discharged from the second nozzle is smaller than a first discharge amount of the liquid to be discharged from the first nozzle;

wherein the cap member further comprises a plate-shaped cap chip which is accommodated in the cap member and prevents a deformation of the cap member during the suction purge;

wherein in the state that the cap member is brought in contact with the liquid droplet jetting surface, a plurality of channels each extending from one of the plurality of nozzles to the opening of the cap member is formed by an inner surface of the cap member and the cap chip, the channels including a first channel and a second channel which is longer than the first channel; and wherein the controller controls the liquid droplet jetting head to perform the flushing such that a fourth discharge amount of the liquid to be discharged from a nozzle from which the second channel extends is smaller than a third discharge amount of the liquid to be discharged from a nozzle from which the first channel extends.

7. A liquid droplet jetting apparatus which jets liquid droplets of a plurality of types of ink, comprising:

a liquid droplet jetting head, which has a liquid droplet jetting surface on which a plurality of nozzles rows are arranged in a first direction, and which jets the liquid droplets of different types of ink from the plurality of rows respectively;

a cap member which covers the liquid droplet jetting surface of the liquid droplet jetting head and in which an opening, through which an interior of the cap member is communicated with atmospheric air in a state that the liquid droplet jetting surface is covered with the cap member, is formed;

a moving mechanism which moves the cap member to make contact with and separate from the liquid droplet jetting surface; and a controller which controls the liquid droplet jetting head and the moving mechanism;

wherein the each of the nozzle rows extends in a second direction perpendicular to the first direction;

wherein the opening of the cap member is arranged on one end portion in the second direction in the state that the liquid droplet jetting surface is covered with the cap member;

wherein each of the nozzle rows includes a first nozzle and a second nozzle arranged farther than the first nozzle from the opening of the cap member in the state that the liquid droplet jetting surface is covered with the cap member;

wherein the controller controls the moving mechanism to separate the cap member covering the liquid droplet jetting surface from the liquid droplet jetting surface in a state that the interior of the cap member is communicated with the atmospheric air, and controls the liquid droplet jetting head to perform a flushing, in which the liquid droplets are jetted from the nozzles to discharge the ink, such that a second discharge amount of the ink to be discharged from the second nozzle is smaller than a first discharge amount of the ink to be discharged from the first nozzle for each of the nozzle rows.

8. The liquid droplet jetting apparatus according to claim 7;

wherein the liquid droplet jetting head jets the liquid droplets of different colors of ink from the plurality of nozzle rows respectively.

9. The liquid droplet jetting apparatus according to claim 8;

wherein the plurality of nozzle rows includes:

a first nozzle row from which liquid droplets of pigment black ink are jetted; and a second nozzle row from which liquid droplets of dye color ink are jetted.

* * * * *